United States Patent [19]

Dumas

[11] 4,368,603

[45] Jan. 18, 1983

[54] WINDOW WITH A PIVOTABLE FRAME HAVING IN CLOSED POSITION DIFFERENT INCLINATIONS WITH RESPECT TO THE SUN

[76] Inventor: Jean Dumas, 43, Charles Laffitte St., 92200 Neuilly.Sur.Seine, France

[21] Appl. No.: 193,354

[22] Filed: Oct. 2, 1980

[30] Foreign Application Priority Data

Oct. 4, 1979 [FR] France ..... 79 24696

[51] Int. Cl.[3] ..... E06B 1/04; E06B 3/34

[52] U.S. Cl. ..... 52/173 R; 52/204; 49/371; 49/391

[58] Field of Search ..... 52/173 R, 204, 207; 49/371, 388, 390, 391, 392, 40, 41; 160/88, 93

[56] References Cited

U.S. PATENT DOCUMENTS

| | | | |
|---|---|---|---|
| 470,114 | 3/1892 | Eyraud | 49/391 |
| 495,288 | 4/1893 | Almy | 160/88 |
| 1,190,885 | 7/1916 | Gehnrich | 160/93 |
| 1,409,623 | 3/1922 | Trost | 52/64 |
| 1,837,972 | 12/1931 | Klim | 49/333 |
| 1,921,040 | 8/1933 | Reynolds | 52/173 |
| 2,206,478 | 7/1940 | Hennessey | 49/371 |
| 2,900,680 | 8/1959 | Oerly | 52/204 |

FOREIGN PATENT DOCUMENTS

| | | | |
|---|---|---|---|
| 1249961 | 11/1960 | France | 52/390 |
| 2373664 | 7/1978 | France . | |

OTHER PUBLICATIONS

Batir, nr. 89, Nov. 1959, Paris (FR), p. 12, "La Clinique du Parc", col. 2, paragraphs 7 and 8.

*Primary Examiner*—James L. Ridgill, Jr.
*Attorney, Agent, or Firm*—Murray & Whisenhunt

[57] ABSTRACT

A window with a pivotable frame having different inclinations with respect to the sun when in closed condition. There are two inclined fixed casings whose planes cross each other along a straight line which serves as pivoting axis for a window frame. In the closed state of the frame in the first casing the frame is parallel to the rays of the sun on the day of the summer solstice, and in the second casing it is perpendicular to the rays on the day of the winter solstice.

7 Claims, 3 Drawing Figures

2
4
SE
SH
5B
10
S
5A
8
6
11
1
F
9
11
7
8
10
I
3
2

WINDOW WITH A PIVOTABLE FRAME HAVING IN CLOSED POSITION DIFFERENT INCLINATIONS WITH RESPECT TO THE SUN

BACKGROUND OF THE PRESENT INVENTION

It is the object of the present invention to provide a window whose inclination—and consequently the inclination of the window pane—can be modified vertically.

It is known that the passage of solar energy through a window pane depends largely on the angle of incidence of the rays which impinge on said pane. It is therefore desirable to be able to incline window panes in different ways so that the entry of sun rays can either be facilitated or hindered. This is especially recommended for window panes in movable frames which are normally used in houses.

The main object of the invention is therefore to provide a novel type of window which has the possibility of adjusting the inclination of the window panes.

It is also known that special window glass exists which has the property of allowing solar energy to penetrate more easily in one direction than in the other. These special glass panes have to be reversed in order to allow greater or smaller penetration by the rays of the sun into a room.

It is another object of the invention to provide a window in which such special window panes are used and which allow their easy reversal.

It is obvious that upon combining the two effects, i.e. the vertical modification of the inclination and the reversal of the special window panes, the most favorable result in one or the other sense can be attained.

It is therefore another object of the invention to provide a window which allows in a simple and practical way the combination of the two effects by means of commercially available special window glass.

As a result of the earth moving around the sun, the relative position of the latter changes between two extreme positions which are those of the winter solstice and the summer solstice. It is, as a matter of fact, not necessary to be able to modify the inclination of the window panes each day between the solstices. It is often good enough to give the panes or the framed window panes two extreme inclinations, with one of them corresponding to one solstice and the second one to the other solstice. The change from one inclination to the other can, for example, be carried out at the time of an equinox.

Windows which utilize the subject phenomenon are already known, in particular by the U.S. Pat. Nos. 1,409,623 and 2,900,680 where a single casing is employed which holds a pivotable framed window pane.

SUMMARY OF THE PRESENT INVENTION

As distinguished therefrom, the main object of the invention is to provide a window comprising a framed window pane, known as such, which is pivotably mounted on an axis, but with at least two fixed casings in two different positions, with one of these positions corresponding to the winter solstice where the plane of the framed window pane in its tightly closed position is substantially perpendicular to the direction of sun rays from the zenith, and the other position corresponding to the summer solstice where the plane of the framed window pane in its tightly closed position is substantially parallel to the direction of sun rays from the zenith. It is important to note that the upper, lower and lateral closing parts extend between the casings so as to ensure a tight closure toward the outside.

The two fixed casings which are unchangeably set in a summer and in a winter position are each in an inclined plane and these planes cross each other by a straight, intersecting line which serves as a pivoting axis for the framed window pane. The latter can in this manner attain a closed position either in one or the other casing.

BRIEF DESCRIPTION OF THE DRAWINGS

In order to understand the invention better, the preferred embodiment is now described by means of the drawings.

DESCRIPTION OF THE PREFERRED EMBODIMENTS

Figure 1:
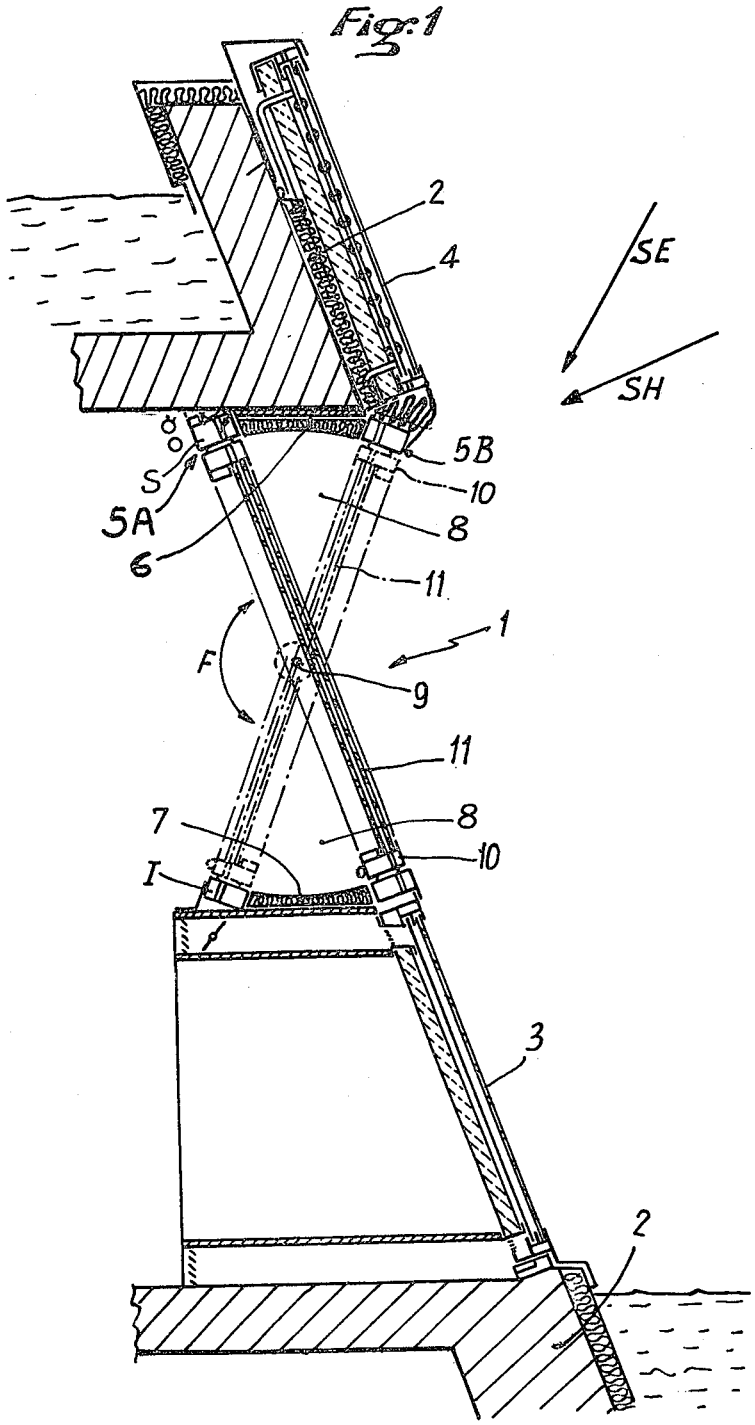
FIG. 1 is a sectional view through a plane which extends along the line I—I of FIG. 2 showing a window according to the invention.
Figure 2:
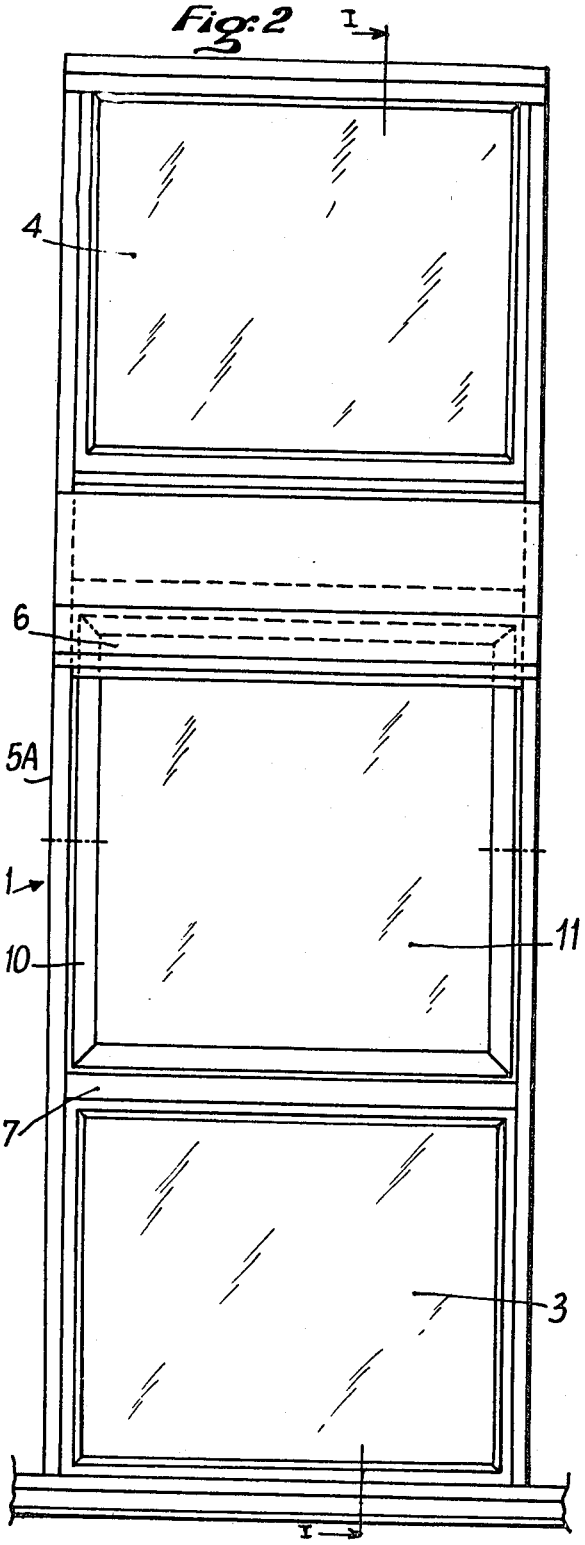
FIG. 2 is a front view of the outside of the window shown in FIG. 1.

In this case the window according to the invention, indicated in its entirety by numeral 1, is incorporated in an outer wall 2 of a building which need not be described. The actual window 1 is associated with a lower solar collector 3 and an upper solar collector 4. This, however, is not imperative. The window according to the invention can be placed directly and exactly into an opening provided in the wall 2.

The window 1 comprises two casings 5A, 5B, each of which is fixed in a given position. The casing 5A is inclined in such a way that it is in a plane which is perpendicular or at least substantially perpendicular to the direction indicated by the arrow SH of the sun rays from the zenith on the day of the winter solstice. The casing 5B is inclined in such a way that it is in a plane which is parallel, or at least substantially parallel, to the direction indicated by the arrow SE of the sun rays from the zenith on the day of the summer solstice.

For fitting the windows into the walls, the two casings 5A, 5B are at their outer perimeter united by the closing parts, which are the upper part 6, the lower part 7 and the lateral part 8. The closing parts 6, 7, 8 can consist of a detachable lining having two resistant outer faces which contain an insulating material, as shown in FIG. 1. It is also possible that the closing parts 6, 7, 8 are formed by the wall 2 itself in filling the outer parts 6, 7 and lateral parts 8 between the casings 5A, 5B, as is the case in the embodiment shown in FIG. 3.

The planes of the two casings 5A, 5B intersect by necessity, since the two directions SE and SH are not parallel in that they create a straight horizontal line.

Figure 3:
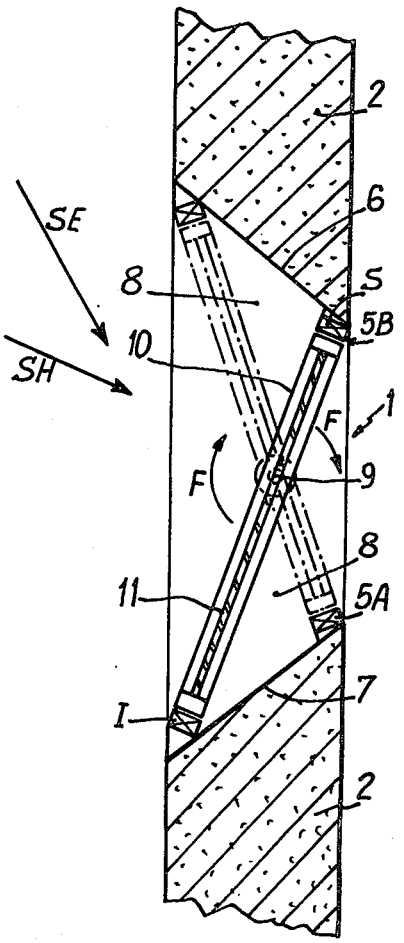
FIG. 3 is a schematic view of a section corresponding to that of FIG. 1 but illustrating another embodiment.

The invention provides that the planes of the two casings 5A, 5B meet along a straight line 9 which extends, as FIGS. 1 and 3 show, between the upper side S and the lower side I.

The line 9 of intersection of the two planes constitutes the pivoting axis of the one single frame 10 provided with a window pane 11. The latter may be of regular or of special quality. According to the invention any kind of suitable material can be used.

By pivoting around the axis 9, the framed window pane 10 can for its closing position either be put into the casing 5A (shown in full lines in FIGS. 1 and 3) or into the casing 5B (shown in a dash-dotted line in FIGS. 1 and 3).

It can be noticed that the framed window pane 10, put into the casing 5A for its closing position in the winter, receives the solar rays SH perpendicularly, at least in the case of FIG. 3 where it is exposed to the rays on its entire surface. The lowermost closing part 3 preferably contains either a black plate which favors the absorption of the solar heat or a solar collector. In the closing position for the summer the framed window pane 10 is parallel to the solar rays SE. In this manner a minimum of heat is allowed to enter the building.

Between the two extreme tight closing positions, the framed window pane 10 can assume any open position to allow inflow or outflow of air.

Means are provided to assure the closing between the framed window pane 10 and the casings 5A, 5B, as well as other means for locking it into the closing positions. It does not appear necessary to describe them here as they are of a known type and are commercially available. They are provided on pivoting or swinging framed window panes which are used with a single fixed casing. Such known means can be easily adapted for obtaining a good, tight closure, e.g. weathertight, of the movable frame 10 inside one or the other casing 5A and 5B.

In FIG. 1 the pivoting axis 9 is in the middle of the height of the casing 5A,5B; in FIG. 3 the axis 9 is at one-third of the height of the casing 5A, and at two thirds of the height of the casing 5B. In a general way it can be said that the axis 9 is in the median zone which is defined by the central third of the height of the casings. It is obvious that by arranging the pivoting axis 9 inside the casings 5A, 5B (FIGS. 1 and 3), it is not only possible to put the framed window pane 10 in its closing position in one or the other casing, but it is also possible to reverse the window pane 11 which is exposed to the outside upon pivoting it as indicated by the arrows F. Thus, the invention allows to make use of the special window glass mentioned above.

In the embodiments described so far the casings 5A and 5B are each fixed in their respective summer and winter positions.

It is easy to imagine to arrange at least one of the casings 5A, 5B in such a way that it becomes adjustable and can assume another desired position in which it is then fixed. The invention covers also this modification according to which at least one of the two casings is adjustable by pivoting it around the axis 9 in such a manner that it can be placed in its extreme position or in another, intermediary one. It is important in this case that the upper closing part 6 and the lower closing part 7 must be arranged in such a way that they do not oppose the displacement of the casing between the positions 5A and 5B. By looking at the embodiment of FIG. 1 it can be noted that the change of position of one of the casings between 5A and 5B is possible in the sense of the arrows F by pivoting it around the axis 9. When, in this modification of the invention, the casing has been placed in the desired position, it is fixed there by means which are known. Thereafter, the framed window pane 10 is used as explained above.

The use of displacable and adjustable casings has an additional advantage. It can be easily seen that instead of giving the casings only two fixed positions, they are adapted to assume several intermediate positions between 5A and 5B in which they can be firmly set. In this manner a more versatile adjustment range is attained by regulating the inclination of the frame 10 and the window pane 11 in a tight closing position in accordance with the changing direction of solar rays between the two solstices.

It is obvious from the preceding description that the window according to the invention is particularly suitable for being placed in walls which face the sun when the sun stands at the zenith. The angles of inclination to be used can be easily determined as a function of the local latitude. This utilization is the most frequent. But it must be understood that the invention is not limited to a use which gives the function of a window optimal conditions only when the sun stands in the zenith. Under certain circumstances, for example in spring or autumn, it is desirable to have a window according to the invention for regulating the penetration of solar energy at any moment of the day other than midday, in a wall which does not face the sun in the zenith. In this case the inclination of the casing or casings is determined as a function of the orientation of the wall and the height of the sun at given times of the annual solar cycle.

For the described embodiments the frames can be made of metal, wood or any other material as well as composite materials. The frames can contain one or several window panes, as well as only a single window pane without a frame.

I claim:

1. A window with a window pane, pivoting around a horizontal axis to assume a first weathertight closing position during one season of the year and a second weathertight closing position during another season, comprising in combination two fixed casings, the first weathertight of which being in a position corresponding to the first weathertight closing position of the window pane, and the second one corresponding to the second weathertight closing position of the same window pane, with the planes of the two fixed casings crossing each other along a straight line which constitutes the pivoting axis of the window pane.

2. A window according to claim 1, wherein the line in which the planes of the two fixed casings meet is situated in a median zone, formed by the central third of the height of one or the other of the casings.

3. A window according to claim 1, wherein the line in which the planes of the two fixed casings meet is situated at one third of the height of the first casing and at two thirds of the height of the second casing.

4. A window according to claim 1, or claim 2 or claim 3, wherein the window pane, being pivoted in the two casings, is so positioned that reversal of the face of the window pane that is exposed to the outside is achievable when the window pane is in its first closing position in one casing or in its second closing position in the other casing.

5. A window according to claim 4, wherein the window pane consists of glass which has different coefficients of penetration by solar energy in one sense than in the opposite sense.

6. Window comprising a first casing fixed in a fluid-tight manner in a first position, a second casing fixed in a fluid-tight manner in a second position, said two casings being located in two planes with different inclinations and said planes intersecting along a straight line, a glass pane being mobile by pivoting around said straight line and being capable of being immobilized in a fluid-tight closed position on the inside of said first casing or in a fluid-tight closed position on the inside of said second casing.

7. Window comprising first casing fixed in a fluid-tight manner in a first position, a second casing that is adjustable and capable to be immobilized in a fluid-tight manner in any of several positions, said two casings being located in planes with different inclinations and said planes intersecting along the same straight line, a glass pane being mobile by pivoting around said straight line and being capable of being immobilized in a fluid-tight closed position on the inside said first fixed casing or in a fluid-tight closed position on the inside of said second casing when said second casing occupies any of its positions.

* * * * *